United States Patent [19]

Komiya et al.

[11] Patent Number: 4,655,977

[45] Date of Patent: Apr. 7, 1987

[54] CLOSED TYPE HEAT EXCHANGER FOR AN EVAPORATION TYPE COOLING TOWER

[75] Inventors: Jujiro Komiya, Hatano; Yuji Kikuchi; Katsuaki Suzuki, both of Fujisawa, all of Japan

[73] Assignee: Shinwa Sangyo Co., Ltd., Tokyo, Japan

[21] Appl. No.: 785,401

[22] Filed: Oct. 8, 1985

[30] Foreign Application Priority Data

Jan. 29, 1985 [JP] Japan ..... 60-14791
Jan. 29, 1985 [JP] Japan ..... 60-14792

[51] Int. Cl.[4] ..... B01F 3/04

[52] U.S. Cl. ..... 261/153; 165/117; 165/134.1; 165/162; 165/900; 261/155; 261/156; 261/DIG. 11

[58] Field of Search ..... 165/69, 76, 117, 134, 165/160, 162, 172, 134 R, 900; 261/153, 155, 156, DIG. 11, DIG. 77; 62/304, 310, 311, 314

[56] References Cited

U.S. PATENT DOCUMENTS

| | | | |
|---|---|---|---|
| 2,009,837 | 7/1935 | Feldmeier | 165/117 X |
| 2,310,121 | 2/1943 | Scherer | 261/153 X |
| 2,384,861 | 9/1945 | Roswell | 261/153 X |
| 2,615,686 | 10/1952 | Davidson | 165/117 |
| 3,415,315 | 12/1968 | Donaldson et al. | 165/69 X |
| 3,447,597 | 6/1969 | McNabney | 165/69 X |
| 3,679,531 | 7/1972 | Wienand et al. | 165/76 X |
| 3,742,725 | 7/1973 | Berger | 165/76 X |
| 4,196,157 | 4/1980 | Schinner | 261/155 |
| 4,306,615 | 12/1981 | Bolton et al. | 165/134.1 X |
| 4,440,698 | 4/1984 | Bloomer | 261/155 X |

FOREIGN PATENT DOCUMENTS

| | | |
|---|---|---|
| 52-75955 | 6/1977 | Japan . |
| 59-37573 | 10/1984 | Japan . |

*Primary Examiner*—Richard L. Chiesa
*Attorney, Agent, or Firm*—Oblon, Fisher, Spivak, McClelland & Maier

[57] ABSTRACT

A heat exchanger comprises a plurality of coil units to form a substantially rectangular prism. Each of the coil units is supported by a pair of supporting frame members through a pair of electrically insulating spacers without direct contact with the supporting frame members.

6 Claims, 9 Drawing Figures

CLOSED TYPE HEAT EXCHANGER FOR AN EVAPORATION TYPE COOLING TOWER

BACKGROUND OF THE INVENTION

1. Field of the Invention

The present invention relates to a closed type heat exchanger for an evaporation type cooling tower.

2. Description of Prior Art

There have been known and developed various closed type heat exchangers.

There is an increased demand for a closed type heat exchanger as disclosed in, for instance, Japanese Examined Utility Model Publication No. 3687/1978 in which bent portions 12 formed at both ends of a serpentine coil 11 are directly supported by a pair of frame members 10 to form a reed-screen-like coil unit 12 (FIG. 8 is referred to) and a requisite number of the coil units are used to put one upon another, thereby fabricating a desired closed type heat exchanger, from the viewpoint that assembling work is easy and allowability in design for determination of loads for cooling is large.

In the conventional heat exchanger fabricated by putting one reed-screen-like coil unit 13 on another in a multi-stage, the bent portions 12 at both sides of the serpentine coils 11 being supported by a pair of the frame members 10, there takes place Galvanic phenomenon due to electric potential difference between the frame members 10 and the bent portions which are made of different kind of metal from the frame members. This results in pin holes at the contacting areas between the frame members 10 and the bent portions 12, which cause leakage of cooling liquid. The corrosion in the coil units reduces the life time of the heat exchanger assembly.

OBJECT OF THE INVENTION

It is an object of the present invention to provide a closed type heat exchanger which eliminates risk of corrosion in the coil units and allows easy work to assemble the coil units.

SUMMARY OF THE INVENTION

The foregoing and the other objects of the present invention have been attained by providing a closed type heat exchanger for an evaporation type cooling tower to cool a cooling liquid flowing in the coil units under condition isolated from the atmosphere characterized in that the heat exchanger comprises a plurality of coil units to form a substantially rectangular prism, wherein each of the coil units is supported by supporting frame members through electrically insulating spacers without direct contact with the supporting frame members.

DETAILED DESCRIPTION OF PREFERRED EMBODIMENTS

Preferred embodiments of the present invention will be described with reference to the drawings.

Figure 1:
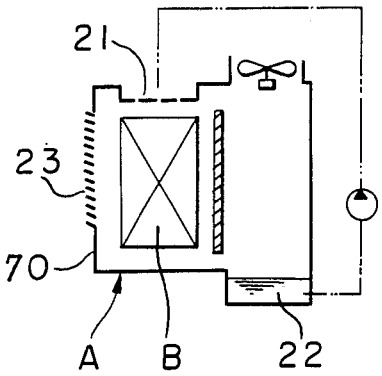
FIG. 1 is a diagram showing an evaporation type cooling tower in which a heat exchanger of the present invention is installed.

FIG. 1 is a diagram showing a cross-flow type cooling tower in which at least one closed type heat exchanger B is placed between an upper water tank 21 and a lower water tank 22 in a cooling tower main body 70.

The heat exchanger B is in a shape of generally rectangular prism and is supported by a pair of supporting frame members which are secured to inner surfaces of the main body 70 at the right and left sides of an air intake opening 23 of a cooling tower A through electrically insulating spacers so as not to contact with the supporting frame members.

Figure 2:
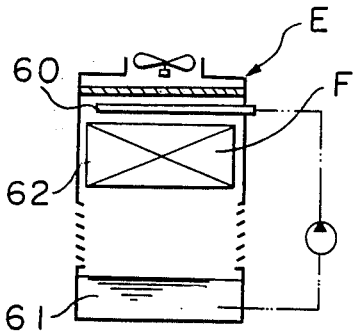
FIG. 2 is a diagram showing another evaporation type cooling tower in which a heat exchanger of the present invention is installed.

FIG. 2 is a diagram showing a counter-flow type cooling tower E in which at least one heat exchanger F is placed between an upper water spraying device 60 and a lower water tank 61 in a cooling tower main body 62.

Figure 3:
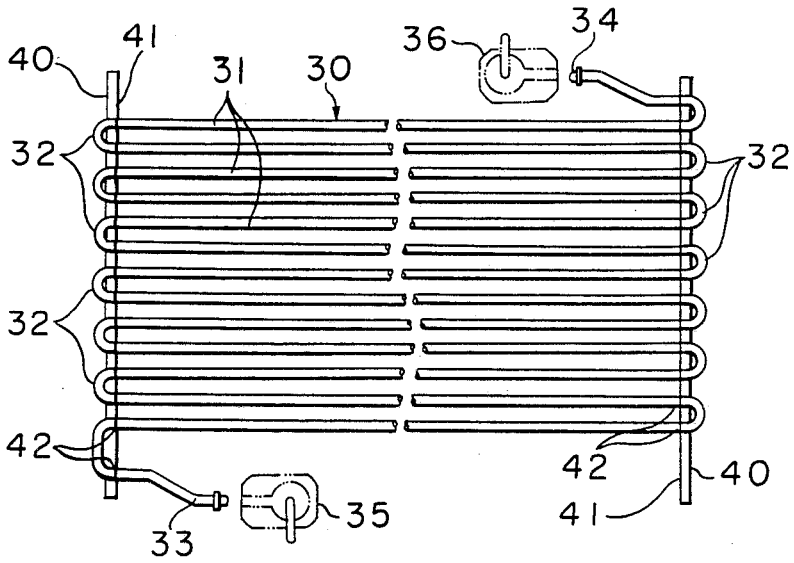
FIG. 3 is a front view of an embodiment of a coil unit used for a closed type heat exchanger according to the present invention.
Figure 4:
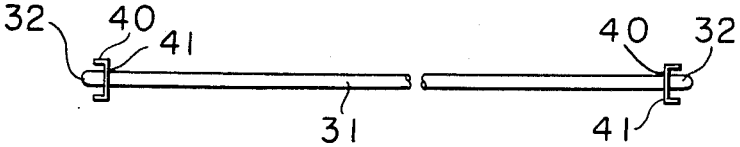
FIG. 4 is a side view of the coil unit shown in FIG. 3.

FIGS. 3 and 4 showing a heat exchanger coil unit 30 which is a unit for constituting the heat exchanger B. The coil unit 30 comprises a plurality of linear tubes 31 in parallel to each other, a plurality of U-shaped bent tubes 32 connected to the end openings of two adjacent linear tubes to form a zig-zag flow path for a cooling liquid and a pair of spacers 40 fitted to both end portions of the linear tubes 31. The spacers 40 are made of vinyl chloride and have an elongated body of a channel shape in cross section. The spacers 40 hold the linear tubes 31 so that they are in parallel to each other and at constant intervals, and also the spacers hold them at or near the joint portions of the linear tubes 31 and the bent tubes 32.

Figure 6:
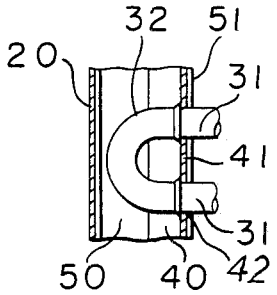
FIG. 6 is a plan view partly sectioned of a joint portion and an insulating support member in FIG. 5.
Figure 5:
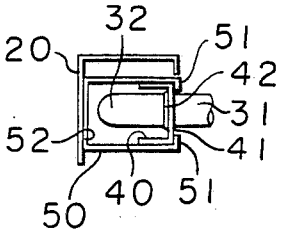
FIG. 5 is an enlarged side view showing a joint portion of a coil unit and an insulating support member according to the present invention.

As shown in FIGS. 5 and 6 showing one end of the coil unit 30, the coil unit 30 is supported at its both ends by a pair of supporting frame members 20 secured to the inner side surfaces of the cooling tower main body through a pair of spacer receiving members 50 in a substantially horizontal position. Each of the spacer receiving members 50 has a shape of channel in cross-section in which a pair of pawls 51 are integrally formed at both free ends of the opening of the channel so as to extend inwardly. Accordingly, the coil unit 30 is slidingly inserted from a side open end of the elongated spacer receiving members 50 with the spacers 40. As a result, the linear tubes 31 and the bent tubes 32 of the coil unit 30 can be supported by the pair of supporting frame members 20 through the pair of spacers 40 without contact to the supporting frame members 20.

In FIG. 3, a reference numeral 35 designates a cooling liquid supply side header 35 which is vertically extended in the cooling tower at the side of a blower, to which an end for supplying a cooling liquid of the coil unit 30 is connected through a union joint, and a reference numeral 36 designates a cooling liquid discharge side header 36 which is vertically extended at the side of the air intake opening 23, to which another end of the coil unit 30 is connected through a union joint. Accordingly, the cooling liquid supplied from the supplying side header 35 is passed through the coil unit 30 to be discharged to the discharge side header 36. The cooling liquid is cooled by air which flows from the air intake opening 23.

Figure 7:
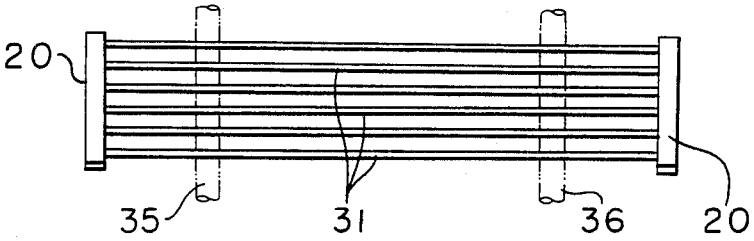
FIG. 7 is a front view of a closed type heat exchanger comprising a plurality of assembled coil units.
Figure 8:
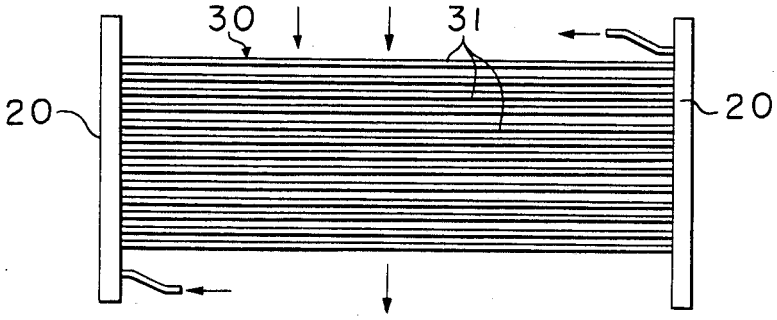
FIG. 8 is a plan view of the heat exchanger in FIG. 7.
Figure 9:
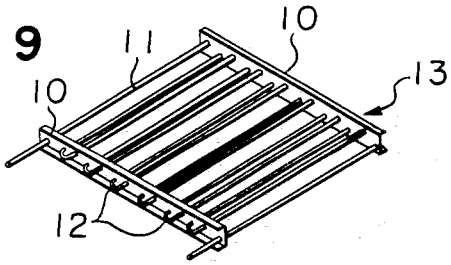
FIGURE 9 PRIOR ART
FIG. 9 is a perspective view of a conventional coil unit.

FIGS. 7 and 8 show a closed type heat exchanger assembled by using a plurality of the above-mentioned coil units 30. In this embodiment, a coil unit 30 comprises fourteen linear tubes and six coil units 30 are arranged, both end portions of the coil units being held by a pair of supporting frame members 20.

As shown in FIGS. 3 to 6, each of the spacers 40 is an elongated body having a shape of a channel in cross-section. Each of the coil units 30 is supported by inserting the spacers 40 at its both ends into each of the spacer receiving members 50 which are fixed to the inner surface of the supporting frame members so that the end 33 at the cooling liquid supplying side is higher than the end 34 at the discharge side, i.e. the coil unit 30 is placed in a slightly inclined state. The spacer receiving member 50 is an elongated body having a shape of a channel in cross-section in which a pair of pawls 51 are formed at both edges of the opening of the channel so as to extend inwardly. When the coil unit 30 is fitted to the pair of supporting frame members 20, each of the spacers 40 is inserted into each of the spacer receiving members 50 from an opening at one end of the spacer receiving member.

Each of the spacers 40 is provided with a plurality of small apertures 42, which correspond to the diameter of the linear tubes 31 of the coil unit 30, in the vertical wall 41 at constant intervals in the longitudinal direction of the spacer 40. Each joint portion of the linear tube 31 and the bent portion 32 of the coil unit 30 is supported by each of the apertures 42 so as to be immovable in the vertical and horizontal directions. Accordingly, the coil units 30 are supported in a multi-stage at a desired number such as six without direct contact of the bent tubes 32 and the linear tubes 31.

A tube end piece 52 may be attached to the inner bottom of the spacer receiving member 50 having a channel shape so as not to contact with the bent tube 32 of the coil unit extending from the vertical wall 41 of the spacer 40 toward the supporting frame member 20.

The shape of the spacer 40 is not limited to have a channel shape as shown in the embodiment and may be an L-shape in cross-section, and it may have another shape as long as the spacer 40 supports the coil unit 30 with respect to the supporting frame member 20 in a non-contact state.

In the embodiment, the spacer 40 is formed by a plate of vinyl chloride. However, it may be made of another material having electrically insulating properties.

Number of linear tubes constituting a coil unit 30 is selected in consideration of cooling performance of the heat exchanger assembly B.

The closed type heat exchanger assembly B having the construction as above-mentioned is fabricated as follows.

A desired number of linear tubes 31 and the bent tubes 32 is prepared to fabricate a heat exchanger coil unit 30 having a desired capacity.

The linear tubes 31 is arranged in parallel to each other at constant intervals in the same plane. The linear tubes 31 are fitted to a pair of the spacers 40 of an elongated body having a channel shape in cross-section and having electrically insulating properties by inserting both ends of the linear tubes 31 into small apertures 42 formed in the vertical walls 41 of the spacers 40 formed at constant intervals in the longitudinal direction, whereby the linear tubes 31 are held in parallel to each other at constant intervals. In this case, the opening of the channel of each of the spacers 40 is directed outwardly. The bent tubes 32 are connected by, for instance, brazing two end openings of the linear tubes 31 so that end parts of the linear tubes to be connected by the bent tubes at one side is shifted by one to the end portions at the other side of the linear tubes, whereby a coil unit 30 having hermetic joint portions and a zig-zag cooling liquid passage can be formed.

A desired number of the coil unit 30 fabricated as above-mentioned is used to constitute a closed type heat exchange assembly B having a desired cooling capacity.

A plurality of the spacer receiving members 50 having a shape of a channel with a pair of pawls 51 at both opening edges in cross section are attached to the supporting frame member 20 in parallel to each other with a suitable distance so as to direct the openings inwardly. A pair of the supporting frame members 20 are fixed to opposed inner walls of the cooling tower main body. When a desired number of coil units 30 are assembled to the supporting frame members 20, a pair of spacers 40 are inserted into a plurality of linear tubes 31 at the middle portion of the tubes and then, the spacers 40 are moved along the longitudinal direction of the linear tubes 31 toward the joint portions at both ends of the linear tubes. In this case, each of the spacers 40 is slidingly inserted to each of the spacer receiving members 50 attached to the supporting frame members 20 in their longitudinal direction, whereby the spacers 40 at both ends of the coil unit 30 are secured by the spacer receiving members 50 by means of a pair of pawls 51 (FIG. 5). Assembling operation of the coil units 30 is carried out from the lowest position to the upper position sequentially. Thus, the movement of the linear tubes 31 of the coil units 30 in the axial direction is hindered and the coil units 30 is secured in a multi-stage by the supporting frame members 20 without electrically contacting with them.

In this case, each of the bent tubes 32 is separated from the tube end piece 52 attached to the bottom of the channel-shaped spacer receiving member 50, and each of the linear tubes 31 is positioned at the intermediate of the opening of the spacer receiving member 50 between a pair of the pawls 51 without contacting them. Thus, each of the coil units 30 is supported in a substantially horizontal state between the right and left supporting frame members 20 through a pair of the spacers 40 in non-contacting condition.

The cooling liquid supply end 33 of each of the coil units 30 is extended at the same side and is detachably connected to a common, vertically extending cooling liquid supply header 35. In the same manner, the cooling liquid discharge end of each of the coil units 30 is extended in the same side which is opposed to the supply end 33 and is detachably connected to a cooling liquid discharge header 36 which is extended vertically. It is desirable that the discharge side 34 of each of the coil units 30 is slightly lower than the supply end 33. Union joints are used to detachably connect the coil units 30 to the supply and discharge headers 35, 36. Thus, a closed type heat exchanger B consisting of coil units 30 and having a predetermined capacity can be obtained.

Explanation will be made as to function and use of the closed type heat exchanger according to the present invention.

(a) A cross-flow type closed cooling tower having a heat exchanger (FIG. 1)

One or more heat exchanger assemblies B of the present invention are installed in cross-flow type cooling tower A to have a desired cooling capacity in which the cooling liquid discharge ends 34 of the coil units 30 are positioned at the air intake opening side of the cooling tower 70 so that the coil units 30 are placed horizontally to cross an air flow from the air intake opening between the upper water tank 21 and lower water tank 22; the cooling liquid supply and discharge ends 33, 34 of the coil units 30 are respectively connected to the common, vertically extending supply and discharge headers 35, 36. With this arrangement, cooling liquid is supplied simultaneously to the vertically arranged coil units 30 from the supply header 35, the cooling liquid being fed through the zig-zag passages of the coil units 30 to be fed to an apparatus such as a refrigerator through the common discharge header 36.

During circulation of the cooling liquid, air passing through spaces between the coil units 30 and water sprayed from the upper water tank 21 are indirectly contacted to the cooling liquid circulated in the coil units 30 to cool the cooling liquid due to heat exchanging function as in the same manner as the conventional cooling tower.

(b) A counter-flow type cooling tower E with a heat exchanger (FIG. 2)

One or more heat exchanges F fabricated according to the embodiment as above-mentioned are installed between the water spraying device 60 and the water tank 61 in the cooling tower main body 62 so as to position the linear tubes 31 of the coil units 30 in the substantially vertical or horizontal direction. The supply and discharge ends of the coil units 30 are respectively connected to the cooling liquid supply and discharge headers to circulate the cooling liquid. The cooling liquid passed through the coil units 30 is subjected to heat exchange by water sprayed from the spraying device 60 and air flowing upwardly through the spaces formed in the coil units 30, whereby the cooling liquid is cooled as the same manner as the conventional counter-flow type cooling tower.

When the heat exchanger of the present invention is used in the cooling tower A or E, there sometimes takes place a problem of blocking flow of spraying water and air due to deposition of aerobic bacteria to the coil units 30 or adhesion of dirt across the linear tubes 31 of the coil units or deformation or breakage of the coil units 30 owing to a long term use or striking of sand and gravel. In such case, the heat exchanger assembly is disassembled for repairing in the order reverse to the assembling operation. Namely, the cooling liquid supply and discharge headers 35, 36 are detached; coil units 30 are drawn from the spacer receiving members 50. After cleaning the coil units 30 and spacers 40, a broken part of the coil unit 30 is cut away and new linear tube is connected to the coil unit by brazing, or if the coil unit 30 is entirely damaged, new set of coil unit is exchanged for a useless one.

In the present invention, the coil unit 30 is used as a unit. Accordingly, a closed-type heat exchanger having a desired cooling capacity can be obtained by fabricating a suitable number of coil units 30. An evaporation type cooling tower in either counter-flow type or a cross-flow type having various cooling capacities can be manufactured by combination of the desired number of the closed type heat exchanger assemblies. By forming the coil unit 30 and the heat exchanger assembly in a unit, administration in stock, assembling work and repair can be easily done.

In the present invention, each joint portion between the linear tube 31 and the bent tube 32 of the coil unit 30 is supported by the spacer 40, whereby a number of linear tubes 31 can be held in parallel to each other and with a suitable distance by a pair of the spacers 40. Accordingly, the heat exchanger assembly B can be constructed with a relatively small number of parts.

Each of the coil units 30 are held by the right and left supporting frame members 20 through the electrically insulating spacers 40 without contacting with the supporting frame members 20. Accordingly, no Galvanic corrosion takes place between the coil units 30 and the supporting frame members 20 which are made of different metal, whereby a problem of leakage of the cooling liquid from a pin hole which may be caused at the joint portions of the coil units 30 can be eliminated. Accordingly, the coil unit 30 of metal having a high thermal conducting factor can be used regardless of material used for the supporting frame members 20.

The spacers 40 are used as a jig to connect the coil unit to the supporting frame members, whereby efficiency of assembling work is improved. The spacers 40 can be inserted into the spacer receiving members along the longitudinal direction of the members. Accordingly, the coil units 30 can be set at a position to give efficient water spraying operation, and the assemblage and repairing of the heat exchanger can be easy.

When the coil units 30 are attached in a slightly slanting state, the cooling liquid discharge end 32 is slightly lower than the supply end 31 of the coil units 30, the discharge end 32 being at the air intake port side of the cross-flow type cooling tower and the supply end 36 at the blower side. Water is supplied uniformly to the coil units 30 to cool the cooling liquid uniformly since water to be sprayed to the coil units at the air intake opening side is deflected to the inner side due to air flow from the opening. Accordingly, shortage of cooling function is eliminated.

What is claimed is:

1. A closed type heat exchanger for an evaporation type cooling tower, said closed type heat exchanger comprising:

(a) a plurality of spaced, parallel linear tubes;

(b) a plurality of U-shaped bent tubes joining adjacent ones of said plurality of spaced, parallel linear tubes to form a heat exchanger coil unit substantially in the shape of a planar, rectangular prism having two opposing sides;

(c) two elongated spacers made of an electrically insulative material, each one of said two elongated spacers comprising an elongated planar wall and two parallel legs projecting outwardly of said coil unit from opposite side edges of said elongated planar wall to form a channel, said elongated planar wall having a plurality of apertures therethrough sized, shaped, and positioned to receive and to support a corresponding one of said plurality of spaced, parallel linear tubes, one of said two elongated spacers being located at each opposing side of said coil unit;

(d) two elongated spacer receiving members, each one of said two elongated spacer receiving members comprising an elongated planar wall, two parallel legs projecting inwardly of said coil unit from opposite side edges of said elongated planar wall, and two lips, one of said two lips projecting inwardly and toward the other one of said two lips from opposite side edges of said two parallel legs, each one of said spacer receiving members forming an enclosure sized, shaped, and positioned to receive and to support a corresponding one of said two elongated spacers; and (e) two elongated supporting frame members, each one of said two elongated supporting frame members comprising a first elongated wall in planar contact with but overlapping on both sides said elongated planar wall of a corresponding one of said two elongated spacer receiving members, a second elongated wall projecting inwardly of said coil unit from one side edges of said first elongated planar wall, said second elongated wall being parallel to but spaced from one of said two parallel legs of said corresponding one of said two elongated spacer receiving members, and a lip projecting inwardly toward, and being at least approximately coplanar with, but not contacting, the lip on said one of said two parallel legs of said corresponding one of said two elongated spacer receiving members.

2. The closed type heat exchanger for an evaporation type cooling tower according to claim 1, wherein a plurality of coil units are disposed one upon another in said evaporation type cooling tower tyo form a heat exchanger assembly which faces an air intake opening formed in said evaporation type cooling tower.

3. The closed type heat exchanger for an evaporation type cooling tower according to claim 1, wherein a plurality of cooling units are disposed so that the axes of said plurality of spaced, parallel linear tubes are substantially parallel to the axial line of said evaporation type cooling tower.

4. The closed type heat exchanger for an evaporation type cooling tower according to claim 1, wherein said two elongated spacers are made of a resinous material such as vinyl chloride.

5. The closed type heat exchanger for an evaporation type cooling tower according to claim 1, wherein a cooling liquid supply end and a cooling liquid discharge end of said coil unit are detachably fitted to common headers which extend vertically in said evaporation type cooling tower.

6. The closed type heat exchanger for an evaporation type cooling tower according to claim 5, wherein:

(a) said coil unit is placed in a slanting state so that said cooling liquid discharge end is slightly lower than said cooling liquid supply end and (b) said cooling liquid discharge end is at the air intake opening side of said evaporation type cooling tower and said cooling liquid supply end is at the blower side of said evaporation type cooling tower.

* * * * *